United States Patent [19]

Statham

[11] 4,086,865

[45] May 2, 1978

[54] MOORING SYSTEM

[76] Inventor: John Arnold Statham, 68 Battenhall Avenue, Worcester, England

[21] Appl. No.: 787,047

[22] Filed: Apr. 13, 1977

[30] Foreign Application Priority Data

Apr. 23, 1976 United Kingdom ..... 16513/76

[51] Int. Cl.[2] ..... B63B 21/04

[52] U.S. Cl. ..... 114/230; 9/8 R; 61/86; 114/257; 114/293

[58] Field of Search ..... 9/8 R, 8 P; 141/279, 141/387-389; 175/5, 6; 166/.5, .6; 61/86, 87, 88, 101, 104, 46, 53; 114/230, 295, 293, 294, 256, 257

[56] References Cited

U.S. PATENT DOCUMENTS

| | | | |
|---|---|---|---|
| 3,551,005 | 12/1970 | Brun | 166/.5 |
| 3,602,175 | 8/1971 | Morgan | 114/293 |
| 3,664,388 | 5/1972 | Frankel | 114/230 |
| 3,667,605 | 5/1970 | Ziblinski | 61/101 |
| 3,745,774 | 7/1973 | Sharp | 114/295 |
| 3,899,990 | 8/1975 | Le Comte | 9/8 P |
| 3,903,705 | 9/1975 | Beck | 114/293 |

*Primary Examiner*—Trygve M. Blix
*Assistant Examiner*—D. W. Keen
*Attorney, Agent, or Firm*—Blanchard, Flynn, Thiel, Boutell & Tanis

[57] ABSTRACT

For mooring a vessel such as oil tanker, especially in deep water, a support located below the water contains a vertically slidable mooring post which can be lifted by an attached mooring hawser into engagement with a reception chamber formed in the bottom of the vessel. The support may rest on the sea bed in such a way as to be universally swingable but its upper end is restrained by anchor chains. The support cam take the form of an oil reservoir and the mooring post can be a tube through which the oil is transferred to the tanker. The hauling in of the mooring hawser through the reception chamber positions the vessel over the mooring post and the head of the latter is engaged by a resilient gripping ring which can act as an oil seal.

20 Claims, 4 Drawing Figures

MOORING SYSTEM

FIELD OF THE INVENTION

The present invention relates to a mooring system for a sea-going vessel such as a large oil tanker. It concerns a mooring system which can be constructed to carry out other functions as well as the mooring of the vessel, for example, drilling or other sea-bed operations or the storage of oil from an undersea well and the loading of the oil into the vessel.

BACKGROUND OF THE INVENTION

Numerous proposals have been made for systems which will enable an oil tanker to be moored and loaded at an off-shore location in order to transport oil from off-shore wells. The systems at present in use for this purpose are not satisfactory because they are very much subject to the vagaries of wind and weather and in storm conditions are unable to operate. Moreover, the rate at which oil can be loaded requires the tanker to be moored for undesirably long periods having regard to the costs of operation of large tankers.

These deficiencies of existing systems arise primarily from the fact that they use flexible pipes of limited diameter through which the oil is pumped to the tanker. The flexibility is required because of the movement of the vessel at its moorings. By the use of a new mooring system the present invention enables the oil to be conveyed to the vessel through a rigid pipe of large diameter giving a very much higher flow rate.

In accordance with the invention there is provided a method of mooring a vessel wherein the vessel picks up and hauls in a mooring hawser which is attached to a mooring post which is vertically slidable in a support located below the surface of the sea, and the mooring post is lifted by the mooring hawser into engagement with a reception chamber formed in the hull of the vessel.

For carrying out this method the invention provides mooring apparatus comprising a support unit and a mooring post vertically slidable in the support unit and having a mooring hawser attached to its upper end, the hawser having means whereby it can be located by a vessel to be moored, which can then hawl in the hawser and lift the head of the mooring post into a reception chamber in the vessel.

For use in deep water the lower end of the support unit is adapted to rest on the sea-bed in such a manner that the support unit is able to swing in any direction about the lower end, the upper end of the support unit having means for producing restoring forces tending to maintain the support unit in a substantially vertical position. The locating means may comprises a guide line attached to the free end of the mooring hawser and a float connected to the guide line.

In use the lower end of the support rests directly in the sea bed or is pivotally mounted by means of a universal pivot and the upper end lies below the surface of the sea. Only the float is present at or a little below the surface and this constitutes no hazard to shipping. The vessel to be moored can locate the float and draw the mooring post into the reception chamber and in so doing pulls itself into position over the support unit. The mooring post is attached to and supported by the vessel and can rise and fall with the vessel. The coupling of the mooring post to the vessel is, however, such that the vessel can pitch or roll relative to the post and can also swing about the post. The coupling, which can be maintained even in rough weather by reason of this flexibility is primarily by way of the hawser but in addition a resilient, preferably inflatable annular seal may engage around the mooring post. The swinging movement of the support unit and with it, the mooring post, about the lower end of the support unit, facilitates these movements of the vessel.

The invention also provides a vessel which has mooring equipment for cooperation with the mooring apparatus when the latter is in position under the sea and this mooring equipment on the vessel comprises a reception chamber within the hull of the vessel, an opening in the bottom of the vessel for the entry of the mooring post into the reception chamber, and means for hauling in the mooring hawser through the entry opening and the reception chamber to draw the mooring post into the reception chamber, a resilient gripping ring being fitted around the entry opening to engage with the mooring post.

The mooring apparatus may be constructed to enable a variety of operations to be carried out after the vessel has been moored. For example, a drill string could be run down the mooring post and the support unit to carry out drilling operations on the sea bed. In the preferred form of the apparatus the support unit is constructed as an oil reservoir for receiving oil from an off-shore well and the mooring post serves as a transfer pipe for the passage of oil from the reservoir into the moored vessel. The oil transfer can take place without pumps under the pressure of the surrounding sea water and is carried out through a rigid pipe which constitutes the mooring post and can have a large flow cross-section to produce rapid oil transfer.

BRIEF DESCRIPTION OF THE DRAWINGS

The invention will be described in more detail with the aid of an example illustrated in the accompanying drawings, in which.

DETAILED DESCRIPTION

Figure 1:
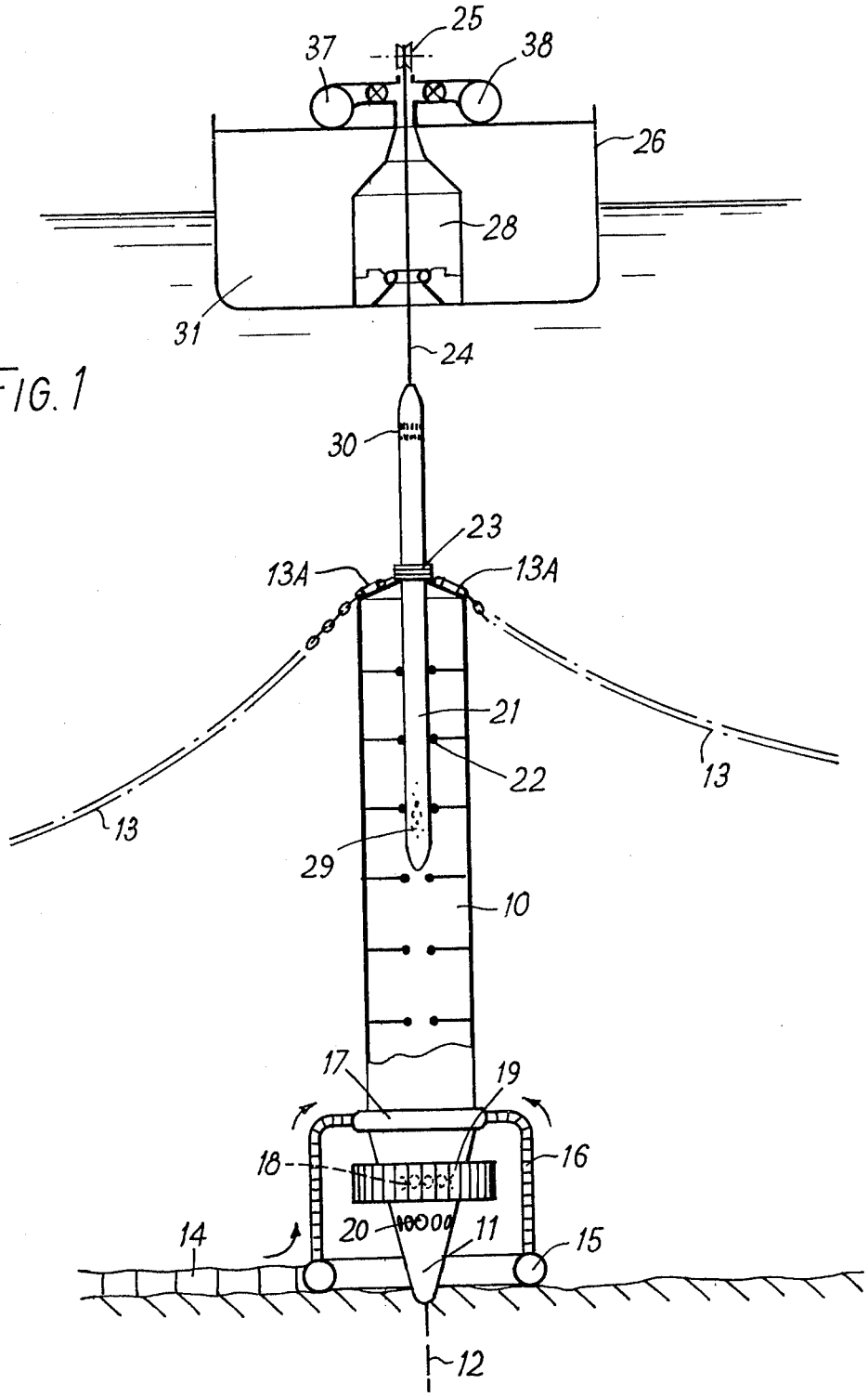
FIG. 1 is a vertical section of mooring apparatus in accordance with the invention and a tanker seen in transverse section in course of being moored.

The mooring apparatus shown in the drawings is intended for the mooring and loading of large oil tankers in exposed locations at sea. The mooring apparatus comprises a support unit in the form of a tall cylindrical oil reservoir 10 with a conical lower part 11 terminating in a domed foot which rests on the sea bed and is anchored there by an anchor cable 12. The reservoir may be constructed of concrete and be, for example, 21 meters in diameter and 110 meters high. The upper end of the reservoir 10 is restrained by a number of anchor chains 13 which are arranged symmetrically around the reservoir and attached to sea bed anchors. The anchor chains 13 are coupled to the reservoir 10 by tensioning devices 13A. The reservoir 10 can then swing through a small angle about its lower end but is subject to restoring forces from the anchor chains which tend to keep it vertical. In an alternative construction the restoring force is wholly or partially provided by a buoyancy chamber built into the upper end of the reservoir.

The reservoir can be filled with oil from one or more wells by way of a pipeline 14 which terminates in an annular oil manifold 15 resting on the sea bed and surrounding the conical lower part 11 of the reservoir. The oil manifold 15 is connected by flexible pipes 16 to an oil inlet manifold 17 surrounding the reservoir at the junction between the cylindrical main part and the conical lower part. The oil entering the reservoir 10 rises to the top and displaces sea water through non-return outlet ports 18 which are fitted with filters 19 to prevent the release of the oil into the sea. The outlet ports 18 are located below the inlet manifold 17 and below the outlet ports are a ring of non-return inlet ports 20 through which sea water can enter the reservoir as oil flows out. In an alternative construction a single set of ports serves as both inlet and outlet for the seawater.

Figure 2:
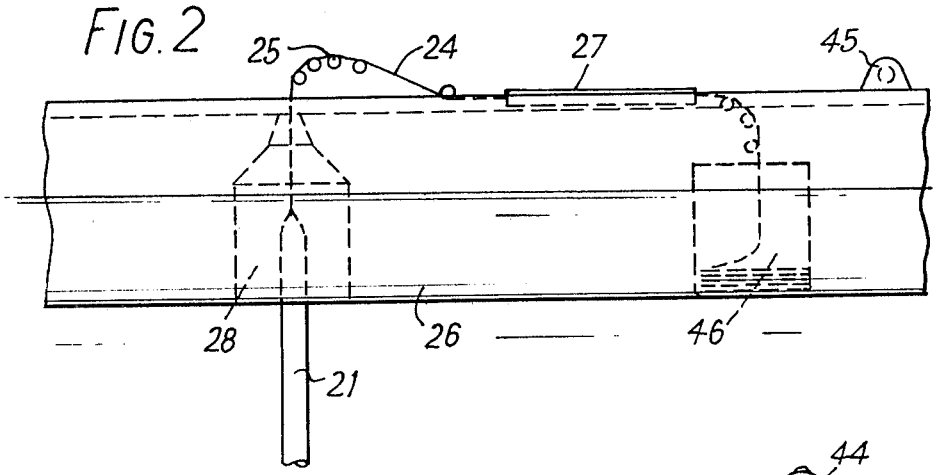
FIG. 2 is a diagrammatic side elevation of part of the tanker.

Mounted coaxially within the reservoir 10 is a mooring post 21 which is guided for vertical sliding movement by guides 22. The post 21 passes through multiple seals 23 at the upper end of the reservoir which are designed to prevent escape of oil from the reservoir. The upper end of the mooring post 21 is attached to a mooring hawser 24 which, as shown in FIGS. 1 and 2, passes over a pulley track 25 on the deck of a tanker 26 to be moored and is hauled in by a gripper and hydraulic jack haulage apparatus 27 to lift the mooring post partly out of the reservoir and engage the top end of the mooring post in a reception chamber 28 in the hull of the vessel 26. The mooring post 21 is a steel pipe which may be 7 meters in diameter and is provided at its lower end with oil inlet holes 29 and at its upper end with oil outlet holes 30. When the upper end of the mooring post has been engaged in the reception chamber 28, oil can flow from the reservoir 10 through the mooring post 21 into the reception chamber 28 and thence into the holds 31 of the tanker.

Figure 3:
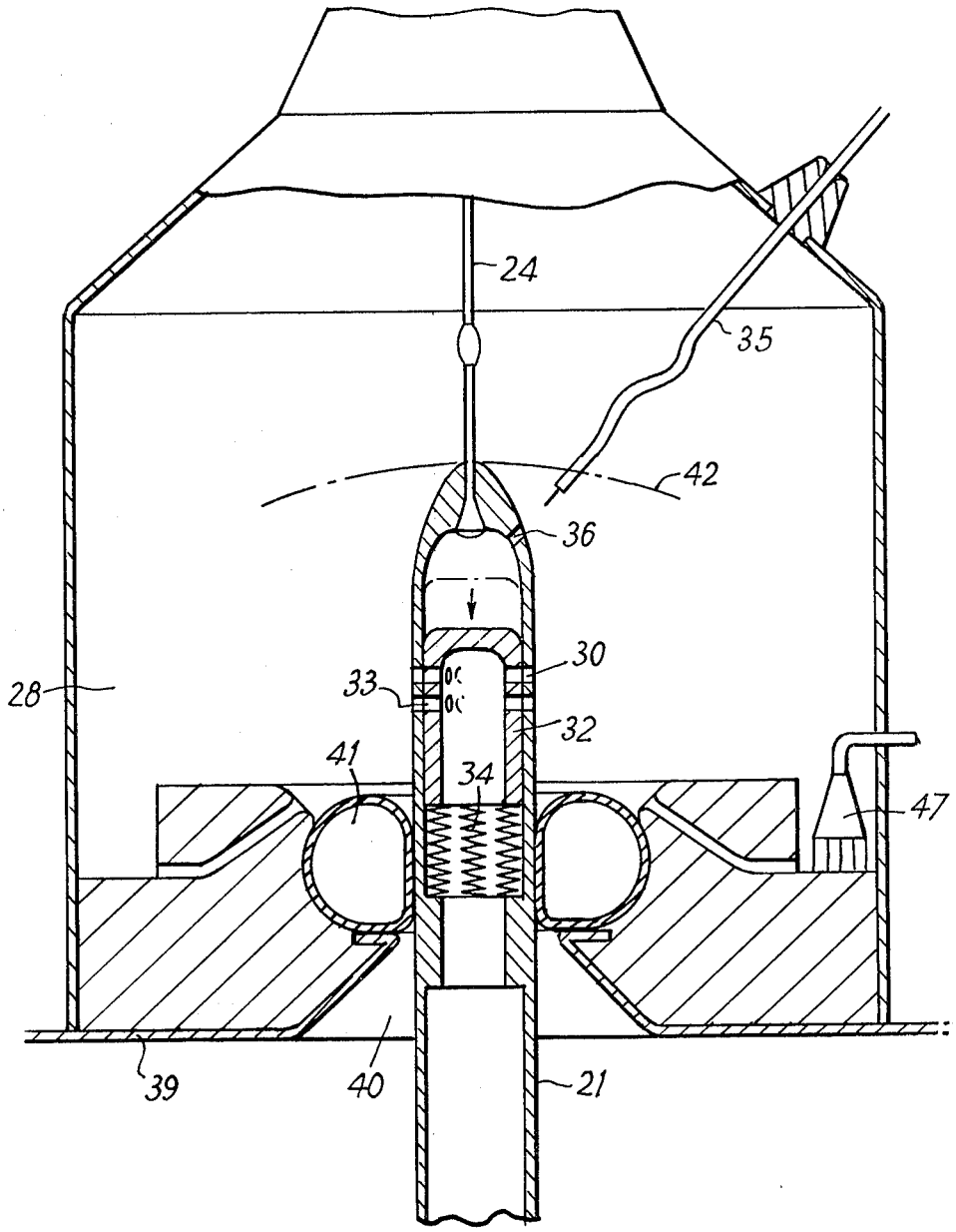
FIG. 3 is a detail of the upper end of the mooring post in position in the reception chamber of the tanker.

Details of the upper end of the mooring post 21 and of the reception chamber 28 are shown in FIG. 3. Within the upper end of the mooring post is a piston 32 which has apertures 33 for registration with the oil outlet holes 30. The piston 32 is biassed by springs 34 towards the uppermost position, shown by a broken line in FIG. 3, in which the outlet holes 30 are closed by the wall of the piston. By the insertion of a flexible air line 35 into a port 36 at the upper end of the mooring post, air can be injected under pressure to force down the piston 32 and thus open the holes 30 for the outflow of oil. As shown in FIG. 1 the upper end of the reception chamber 28 communicates with oil manifolds 37 and 38 which lie along the lengths of the deck and convey the oil to the tanker's holds.

The reception chamber 28 has a bottom wall 39 with a central opening which is defined by a frusto-conical surface 40 forming a lead-in for the mooring post. Around the opening on the inside is mounted an annular inflatable tyre seal 41 to grip the mooring post and provide a seal against outflow of oil. The mooring post remains free to swing through a small angle with its upper end describing an arc such as indicated by the line 42. To permit the movement the attachment of the hawser 24 to the vessel should include a shock absorber system or other resilient device.

Figure 4:
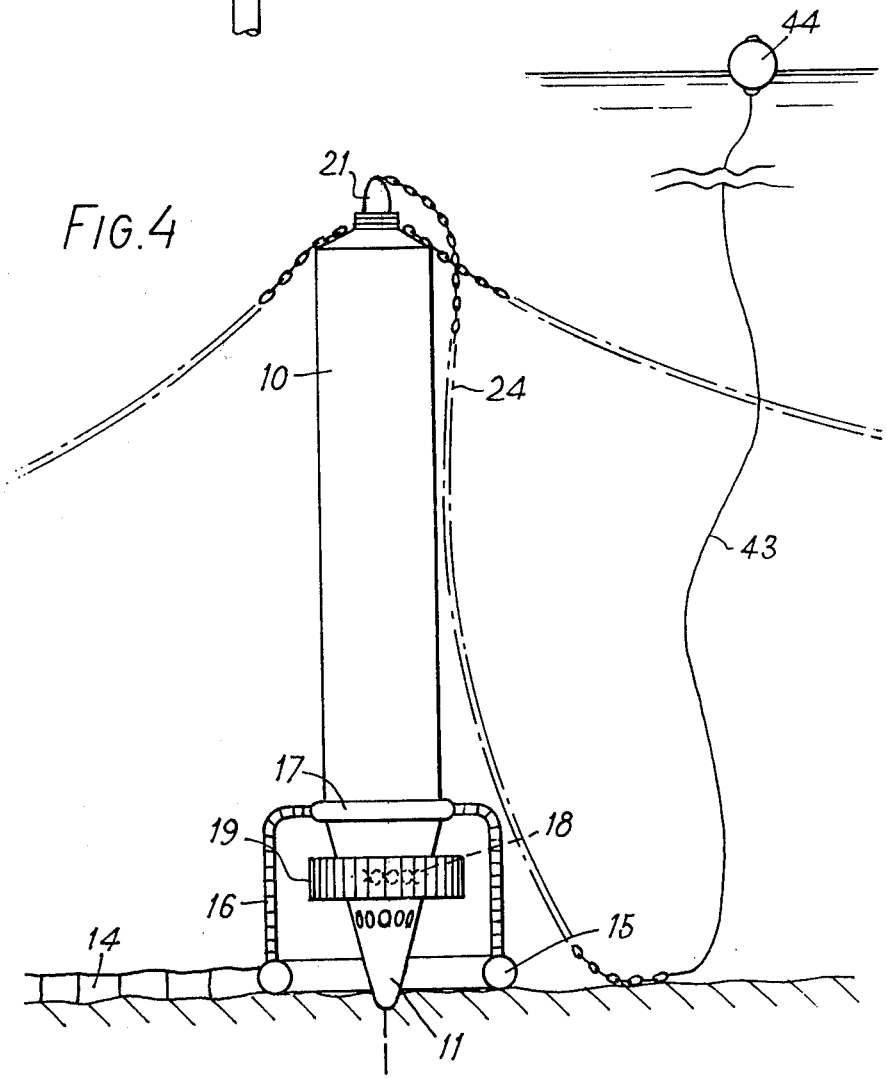
FIG. 4 is a schematic view of the mooring apparatus when not in use.

Referring now to FIG. 4 this shows that in the absence of the tanker the mooring post 21 is retracted into the reservoir 10 and the mooring hawser 24 hangs down the outside of the reservoir. The whole of the apparatus is well below the water surface and presents no hazard to shipping. Attached to the end of the hawser 24 is a guide line 43 to which is attached a float 44. A tanker approaching the apparatus locates the float 44 and picks up the guide line 43, which is passed through the reception chamber 28 and over the pulley track 25 to a winch 45 (FIG. 2). The winch winds in the guide line 43 until the hawser 24 is brought into position for attachment to the haulage apparatus 27 and thereafter the hawser is hauled in and stowed in a locker 46. As the tanker hauls in the hawser and begins to lift the mooring post 21 it loses way and pulls itself into position over the reservoir so that the opening in the bottom of the reception chamber is automatically aligned to receive the mooring post.

After the mooring post has entered the reception chamber and the mooring hawser has been clamped to hold the post in position, the seal 41 is inflated, sea-water is removed from the chamber 28, and the piston 32 is forced down by air pressure to allow oil to flow from the reservoir 10 through the mooring post 21 under the pressure of the surrounding sea water. Because of the large dimensions of the mooring post a large flow cross-section is available and the rate of loading is high. During loading the mooring post rises and falls with the tanker and its weight provides a stabilising influence. The post can sway with the reservoir about the lower end of the reservoir and the post will then pivot relative to the tanker about the inflatable seal. This allows horizontal movements of the tanker. The tanker is free to swing around the axis of the reservoir cylinder. Preferably the reception chamber is arranged forward of the centre of gravity of the tanker both when loaded and when empty so that the tanker tends to remain with its head in the wind.

When the tanker is full the air line 35 is removed and the piston 32 rises to cut off the flow of oil. Scour pumps, of which one is shown at 47 in FIG. 3 are operated to clear oil from the reception chamber 28. The reception chamber is then washed with hot water and steam with the residue being pumped to bilge tanks. When the reception chamber is clean the inflatable seal is deflated and the mooring hawser paid out, followed by the guide line, until the tanker is free to sail away.

The system can also be used for unloading tankers. It can be used in protected inshore waters an in this situation the support unit need not be capable of swinging or swaying about its lower end but can be fixed, for instance, by embedding it in the sea bed. This would be an advantage in shallow water to give adequate storage capacity.

Whereas the system has been described in a form suitable for mooring and loading tankers, it will be appreciated that the mooring function can be combined with other functions in place of oil transfer. For example, the ship may carry a drill or an oil production unit which can be passed down through the mooring post and support unit to the sea bed.

An important modification of the system described is the provision of additional oil storage by the use of satellite reservoirs similar in construction to the main reservoir and arranged in a regular array around the main reservoir. The main anchor chains can be attached to the satellite reservoirs while these are in turn connected by cables to the main reservoir. The upper ends of the satellite reservoirs are connected to the upper end of the main reservoir by hoses and the satellite reservoirs have no oil inlets of their own but do have water inlets and outlets.

Whereas the apparatus has been described in relation to the storage and transfer of oil it will be apparent that it could also be used for liquefied natural gas (L.N.G.) and liquid petroleum gas (N.P.G.).

I claim:

1. Apparatus for mooring a vessel comprising a support unit for installation below the surface of the sea, a mooring post mounted in said support unit for vertical sliding movement, a mooring hawser centrally attached to the upper end of said mooring post whereby the mooring hawser may apply a vertical lifting force to the mooring post, said hawser being of sufficient strength to lift the mooring post when the latter is immersed in the sea, and means attached to said hawser for location by a vessel to be moored, whereby the vessel may haul in the hawser and lift the head of the mooring post into a reception chamber in the vessel, the mooring post being freely slidable relative to said support unit to move vertically with the vessel as the vessel rises and falls.

2. Apparatus as claimed in claim 1 in which the lower end of the support unit is adapted to rest on the sea-bed in such a manner that the support unit is able to swing in any direction about the lower end, the upper end of the support unit having means for producing restoring forces tending to maintain the support unit in a substantially vertical position.

3. Apparatus as claimed in claim 2 in which the lower end of the support unit is of inverted conical formation with a rounded foot intended to penetrate the sea-bed.

4. Apparatus as claimed in claim 2 in which the means for reducing lateral movement comprise attachments for anchor chains distributed around the upper end of the support unit.

5. Apparatus as claimed in claim 4 in which the attachments include tensioning devices for the anchor chains.

6. Apparatus as claimed in claim 1 wherein the location means comprises a guide line attached to the free end of the hawser and a float connected to the guide line.

7. Apparatus as claimed in claim 1 in which the mooring post is a rigid tubular member and has openings at its upper and lower ends.

8. Apparatus as claimed in claim 1 in which the support unit is constructed as a liquid reservoir with openings at its lower end for the inflow and outflow of sea water, means for introduction of liquid into the reservoir, and a seal unit at the upper end of the support unit through which the mooring post passes.

9. Apparatus as claimed in claim 8 in which the reservoir is constructed of concrete.

10. Apparatus as claimed in claim 8 in which the means for introduction of liquid comprises an annular inlet manifold communicating with the interior of the reservoir by way of a plurality of ports, the inlet manifold being constructed for connection to an annular manifold lying on the sea-bed by way of a plurality of flexible hoses.

11. Apparatus as claimed in claim 8 in which the reservoir has internal guides for the mooring post.

12. Apparatus as claimed in claim 8 in which the mooring post is tubular and has inlet holes at its lower end and outlet holes at its upper end, the outlet holes being openable and closable by a valve mechanism.

13. Apparatus as claimed in claim 12 in which the valve mechanism comprises a piston biassed towards the closed position but openable by fluid pressure.

14. A vessel having mooring equipment for co-operation with the mooring apparatus of claim 1, the mooring equipment comprising a reception chamber within the hull of the vessel, an opening in the bottom of the vessel for the entry of the mooring post into the reception chamber, and means for hauling in the mooring hawser through the entry opening and the reception chamber to draw the mooring post into the reception chamber, a resilient gripping ring being fitted around the entry opening to engage with the mooring post.

15. A vessel as claimed in claim 14 in which the gripping ring is arranged as a seal to prevent entry of sea water into the reception chamber.

16. A vessel as claimed in claim 14 in which the reception chamber is provided with means for scouring and cleaning.

17. A vessel as claimed in claim 14 in which the haulage means for hauling in the mooring hawser comprise means for clamping the hawser with sufficient resilience to allow the head of the mooring post to swing within the reception chamber about the gripping ring.

18. A method of mooring a vessel with the apparatus of claim 1 comprising the steps of (a) locating said mooring hawser from the vessel,
(b) passing said hawser through a reception chamber in the hull of the vessel,
(c) attaching said hawser to haulage equipment in the vessel, and
(d) hauling in the hawser to align the mooring post with reception chamber and lift the head of the mooring post into the reception chamber.

19. A method as claimed in claim 18 comprising the further step of gripping the head of the mooring post with a resilient annular gripping means.

20. A method as claimed in claim 19 comprising the further step of transferring liquid from the support unit, which is constructed as a reservoir, through the mooring post into the vessel for transportation.

* * * * *